US006556792B2

(12) United States Patent
Yoshimura

(10) Patent No.: US 6,556,792 B2
(45) Date of Patent: Apr. 29, 2003

(54) ELECTROPHOTOGRAPHIC IMAGE FORMING APPARATUS COMPRISING A MAIN BODY CONTROL MEANS USING INFORMATION STORED AND HELD IN ADVANCE UNDER A PREDETERMINED CONDITION TO MAKE AN IMAGE FORMING OPERATION BY A PROCESS CARTRIDGE POSSIBLE WHEN INTERFERENCE OCCURS TO CARTRIDGE-APPARATUS COMMUNICATION OR A CONTROLLER FOR CONTROLLING AN IMAGE FORMING OPERATION ON THE BASIS OF MAIN BODY INFORMATION STORED IN ADVANCE

(75) Inventor: Shotaro Yoshimura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/749,928

(22) Filed: Dec. 29, 2000

(65) Prior Publication Data

US 2001/0016123 A1 Aug. 23, 2001

(30) Foreign Application Priority Data

Jan. 6, 2000 (JP) ..... 2000-000850

(51) Int. Cl.[7] ..... G03G 15/00

(52) U.S. Cl. ..... 399/9; 399/12; 399/13; 399/111; 399/119

(58) Field of Search ..... 222/DIG. 1; 399/9, 399/12, 13, 24, 25, 27, 28, 29, 30, 111, 119, 120

(56) References Cited

U.S. PATENT DOCUMENTS 6,181,885 B1 * 1/2001 Best et al. ..... 399/12

FOREIGN PATENT DOCUMENTS

JP 11-348375 12/1999

OTHER PUBLICATIONS

U.S. patent application Ser. No. 09/286426, filed Apr. 6, 1999.

* cited by examiner

*Primary Examiner*—Hoang Ngo
(74) *Attorney, Agent, or Firm*—Fitzpatrick, Cella, Harper & Scinto

(57) ABSTRACT

An electrophotographic image forming apparatus on the main body of which a process cartridge is detachably mountable and for forming an image on a detachably mountable and for forming an image on a recording medium includes (a) a mounting device for detachably mounting the process cartridge having an electrophotographic photosensitive member, a process device for acting on the electrophotographic photosensitive member, and a cartridge radio communication device having a memory element for storing therein information necessary for the image forming operation performed by the process cartridge when the process device is caused to act on the electrophotographic photosensitive member to thereby form an image on the recording medium, and radio-communicating to the main body the information stored in the memory element, (b) a main body radio communication device having a controlling portion for effecting the reading and writing of the information to the memory element of the cartridge radio communication device, and radio-communicating to the cartridge radio communication device the information for the controlling portion to effect reading and writing to the memory element, and (c) a main body control device using the information stored and held in advance under a predetermined condition to make the image forming operation by the process cartridge possible when interference occurs with the radio communication by the cartridge radio communication device and the main body radio communication device.

10 Claims, 6 Drawing Sheets

ELECTROPHOTOGRAPHIC IMAGE FORMING APPARATUS COMPRISING A MAIN BODY CONTROL MEANS USING INFORMATION STORED AND HELD IN ADVANCE UNDER A PREDETERMINED CONDITION TO MAKE AN IMAGE FORMING OPERATION BY A PROCESS CARTRIDGE POSSIBLE WHEN INTERFERENCE OCCURS TO CARTRIDGE-APPARATUS COMMUNICATION OR A CONTROLLER FOR CONTROLLING AN IMAGE FORMING OPERATION ON THE BASIS OF MAIN BODY INFORMATION STORED IN ADVANCE

BACKGROUND OF THE INVENTION

1. Field of the Invention

This invention relates to an electrophotographic image forming apparatus for forming an image on a recording medium and on which a process cartridge is detachably mountable.

Here, the electrophotographic image forming apparatus is an apparatus for forming an image on a recording medium by the use of the electrophotographic image forming method. Examples of the electrophotographic image forming apparatus include, for example, an electrophotographic copier, an electrophotographic printer (such as a laser printer or an LED printer), a facsimile apparatus and a word processor.

Also, the term "process cartridge" refers to charging means, developing means or cleaning means as process means and an electrophotographic photosensitive member integrally made into a cartridge that is detachably mountable to the main body of the image forming apparatus. Or at least one of charging means, developing means and cleaning means as process means and an electrophotographic photosensitive member that are integrally made into a cartridge that is detachably mountable to the main body of the image forming apparatus. Further, the term "process cartridge" also refers to at least developing means as process means and an electrophotographic photosensitive member integrally made into a cartridge that is detachably mountable to the main body of the image forming apparatus.

2. Related Background Art

In an electrophotographic image forming apparatus using the electrophotographic image forming process, there has heretofore been adopted a process-cartridge system in which an electrophotographic photosensitive member and process means for acting on this electrophotographic photosensitive member are integrally made into a cartridge that is made detachably mountable to the main body of the image forming apparatus. According to this process cartridge system, the maintenance of the apparatus can be done by a user himself without resorting to a serviceman and therefore, operability could be markedly improved. So, this process-cartridge system is widely used in image forming apparatuses.

In such an electrophotographic image forming apparatus, a memory unit is provided in the process cartridge and information necessary for the image forming operation (printing operation) of forming an image on a recording medium by the process cartridge is stored and held in that memory unit. The main body of the image forming apparatus is provided with a transmitting and receiving unit for communicating with the memory unit and reading information necessary for the image forming operation. In starting the printing operation, various parameters necessary for the printing operation stored and held in advance in the memory unit are read through the transmitting and receiving unit, and the printing operation is performed while the control of each portion is effected in accordance with the parameters. In this case, when for some reason or other, communication with the memory unit cannot be effected, it is judged to be trouble and the printing operation is stopped.

SUMMARY OF THE INVENTION

The present invention is the further development of the above-described conventional art.

It is an object of the present invention to provide an electrophotographic image forming apparatus that can perform the image forming operation by a process cartridge even when interference occurs with the communication of information necessary for the image forming operation that is stored and held on the process-cartridge side.

It is another object of the present invention to provide an electrophotographic image forming apparatus that uses prestored information under a predetermined condition to make the image forming operation with a process cartridge possible when interference occurs to the radio (wireless) communication between cartridge radio-communication means and main-body-radio-communication means.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Some embodiments of the present invention will hereinafter be described with reference to the drawings.

Figure 3:
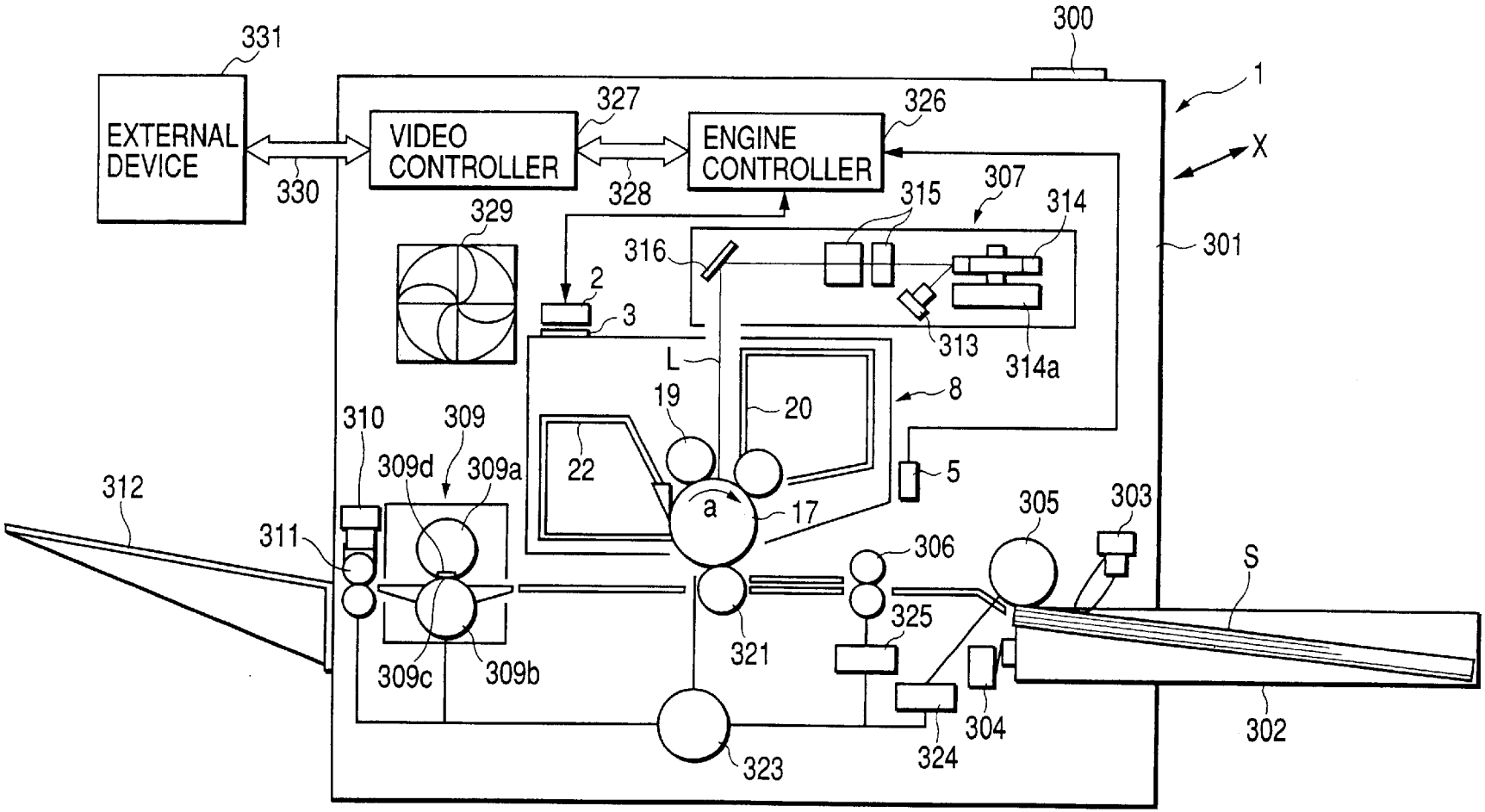
FIG. 3 schematically shows the general construction of the electrophotographic image forming apparatus according to Embodiment 1.
Figure 6:
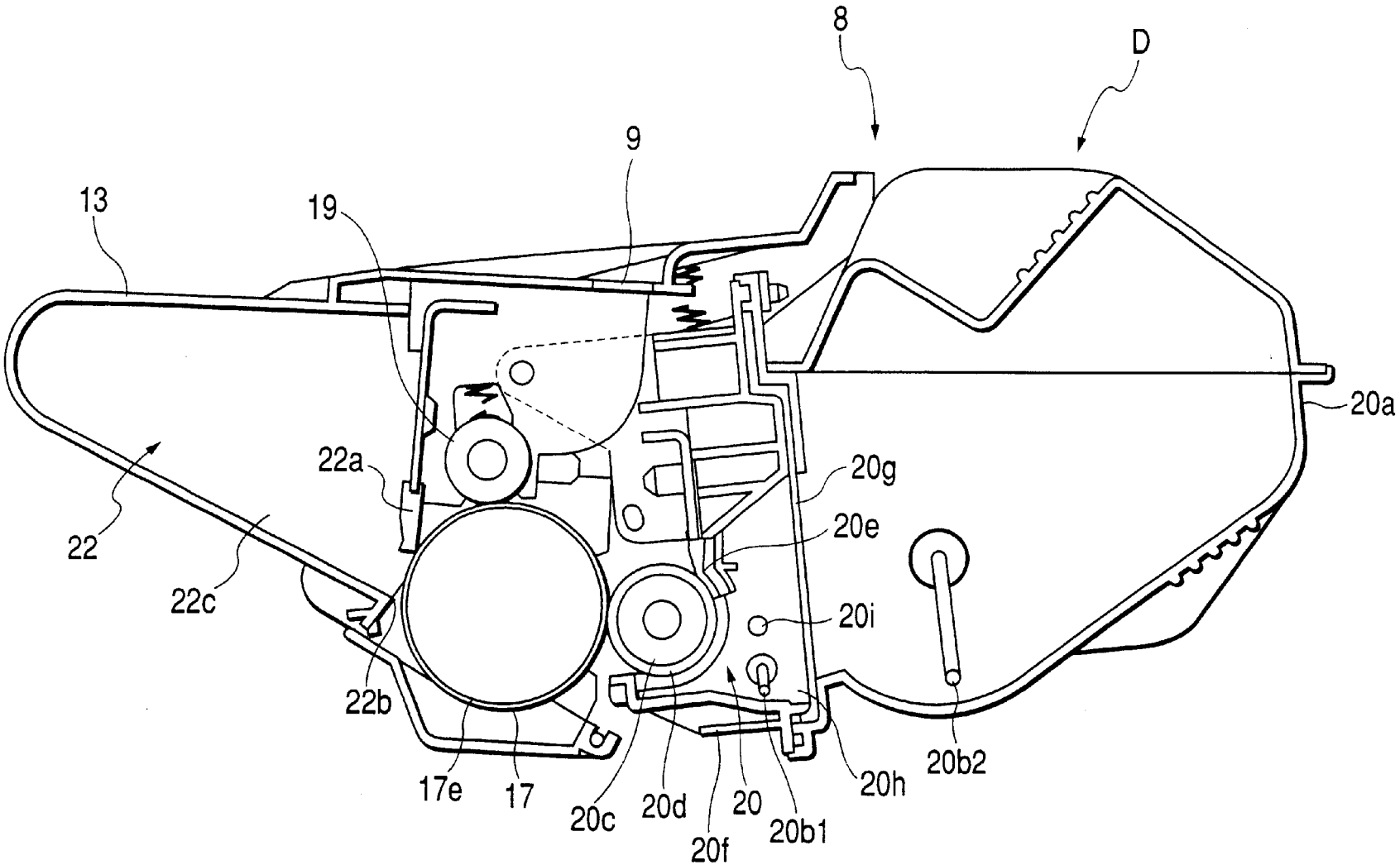
FIG. 6 is a longitudinal cross-sectional view schematically showing the construction of the process cartridge.

Reference is first had to FIGS. 3 and 6 to describe an electrophotographic image forming apparatus (laser beam printer) using the electrophotographic process according to the present embodiment and a process cartridge use in this electrophotographic image forming apparatus. FIG. 3 schematically shows the construction of an example of the electrophotographic image forming apparatus (laser beam printer) according to the present embodiment, and FIG. 6 schematically shows the construction of the process cartridge.

(General Construction)

In FIG. 3, the reference numeral 17 designates a drum-shaped electrophotographic photosensitive member (hereinafter referred to as the "photosensitive drum") rotatively driven in the clockwise direction indicated by the arrow "a" at a predetermined peripheral speed (process speed).

The photosensitive drum 17, in the rotation process thereof, is uniformly charged to a predetermined polarity and potential by a primary charging roller 19 as charging means. Scanning exposure L by a laser beam outputted from a laser scanner portion 307 and modulation-controlled (ON/OFF-controlled) correspondingly to the time-series electric digital pixel signal of desired image information is effected on the uniformly charged surface of the photosensitive drum 17, whereby the electrostatic latent image of the desired image information is formed on the surface of the photosensitive drum 17.

The electrostatic latent image formed on the photosensitive drum 17 is developed and visualized with a developer (toner) by a developing device 20 as developing means.

On the other hand, recording media (hereinafter referred to as the "recording sheets") S such as recording paper, OHP sheets or cloth contained in a feed cassette 302 are fed one by one by the driving of a feed roller 305, and are fed to a transferring nip portion, which is the pressure contact portion between the photosensitive drum 17 and a transfer charging roller 321 as transferring means at a predetermined control timing by a pair of registration rollers 306, and the toner image on the surface of the photosensitive drum 17 is sequentially transferred to the surface of the recording sheet S.

The recording sheet S that has left the transferring nip portion is sequentially separated from the surface of the photosensitive drum 17 in its rotation process, and is introduced into a fixing device 309 for fixing the toner image. The fixing device 309 is comprised of a fixing film 309*a,* a pressure roller 309*b,* a ceramic heater 309*c* provided in the fixing film 309*a,* and a thermistor 309*d* for detecting the surface temperature of the ceramic heater 309*c*. The heat of the ceramic heater 309*c* is applied through the fixing film 309*a* to the recording sheet S passing between the fixing film 309*a* and the pressure roller 309*b* and also pressure is applied to the recording sheet S by the pressure roller 309*b* to thereby heat and fix the transferred toner image.

The recording sheet S, which has left the fixing device 309, is printed out onto a stack tray 312 by discharge rollers 311.

Also, the surface of the rotatable photosensitive drum 17, after the recording sheet S has been separated therefrom, has adhering contaminant, such as the untransferred toner thereon, removed by a cleaning device 22 as cleaning means and is thus cleaned, and is used for the image formation in the electrophotographic process repeatedly started from the charging step.

In the laser scanner portion 307, the reference numeral 313 denotes a laser unit that emits a laser beam modulated on the basis of an image signal (image signal VDO) delivered from an external device 331 such as a personal computer. The reference numeral 314 designates a polygon mirror for scanning the laser beam from the laser unit 313 to the photosensitive drum 17, the reference character 314*a* denotes a motor for rotating the polygon mirror 314, the reference numeral 315 designates an imaging lens group, and the reference numeral 316 denotes a turn-back mirror.

The reference numeral 303 designates a cassette presence/absence sensor for detecting the presence or absence of the recording sheets S in the cassette 302, the reference numeral 304 denotes a cassette size sensor (comprised of a plurality of microswitches) for detecting the size of the recording sheets S in the cassette 302, and the reference numeral 310 designates a sheet discharge sensor for detecting the conveyed state of the recording sheets S in the sheet discharge portion. The reference numeral 329 denotes an exhaust heat fan.

The reference numeral 323 designates a main motor which gives a driving force to the feed roller 305 through a feed roller clutch 324 and to the pair of registration rollers 306 through a registration roller clutch 325, and further gives a driving force to each unit of the process cartridge 8 including the photosensitive drum 17, the fixing device 309 and the sheet discharge rollers 311.

The reference numeral 326 denotes an engine controller as main body control means for controlling the entire apparatus, and it effects the control of the electrophotographic process by the laser scanner portion 307, the process cartridge 8 and the fixing device 309, and the conveyance control of the recording sheets S in the main body (hereinafter referred to as the "printer main body") 301 of the electrophotographic image forming apparatus 1.

The reference numeral 327 designates a video controller connected to the external device 331 such as a personal computer by a universal interface (such as centronics or RS232C) 330, and it evolves image information sent from this universal interface into bit data, and delivers the bit data as a VDO signal to the engine controller 326 through an interface 328.

(Process Cartridge)

On the other hand, the process cartridge is provided with the electrophotographic photosensitive member and at least one process means. Process means include, for example, charging means for charging the electrophotographic photosensitive member, developing means for developing the electrostatic latent image formed on the electrophotographic photosensitive member, cleaning means for removing any toner residual on the surface of the electrophotographic photosensitive member, etc. The process cartridge 8 in the present embodiment, as shown in FIG. 6, is designed such that the photosensitive drum 17, which is the electrophotographic photosensitive member having a photosensitive layer 17*e,* is rotated and a voltage is applied to the charging roller 19, which is the charging means, to thereby uniformly charge the surface of the photosensitive drum 17, and this charged photosensitive drum 17 is exposed to the laser beam from the laser scanner portion 307 through an exposure opening portion 9 to thereby form an electrostatic latent image, which is then developed by the developing means 20.

The developing means 20 feeds out the toner to the opening portion 20*g* of a toner containing frame 20*a* by a rotatable toner feeding member 20*b*2, which is toner feeding means in the toner containing frame 20*a,* feeds out this toner into a toner developing frame 20*f* through the opening portion 20*h* of the toner developing frame 20*f,* agitates this toner by a toner agitating member 20*b*1, rotates a developing roller 20*d* which is a developer rotary member (developer bearing member) containing a stationary magnet 20*c* therein and also forms a toner layer induced triboelectrification charge on the surface of the developing roller 20*d* by a developing blade 20*e,* and shifts the toner to the photosensitive drum 17 in conformity with the electrostatic latent image to thereby form a toner image and make it into a visible image. The developing roller 20*d* is rotated with the photosensitive drum 17 and supplies the toner to the photosensitive drum 17.

A voltage opposite in polarity to the toner image is applied to a transferring roller 321 to thereby transfer the toner image to the recording medium 2, whereafter the toner residual on the photosensitive drum 17 is scraped off by a cleaning blade 22*a* and dipped by a dip sheet 22*b,* and the residual toner on the photosensitive drum 17 may be removed by the cleaning means 22 for collecting the removed toner into a removed toner containing portion 22*c*.

The process cartridge 8 shown in the present embodiment comprises the toner containing frame 20*a* supporting the toner feeding member 20*b*2, so as to be rotatively driven, and the toner developing frame 20*f* containing therein developing members such as the developing roller 20*d* and the developing blade 20*e,* the toner containing frame 20*a* and the toner developing frame 20*f* being welded together to thereby make a developing unit D, and a cleaning frame 13 having the removed toner containing portion 22*c* and holding the photosensitive drum 17, the cleaning blade 22*a,* the dip sheet 22*b* and t:he charging roller 8, the cleaning frame 13 being coupled to the developing unit D to thereby make a cartridge. This process cartridge 8 is detachably mounted to cartridge mounting means provided in the printer main body 301.

This cartridge mounting means is such that when a door 202 (see FIG. 2) as an openable and closable member openably and closably provided on the upper portion of the printer main body 301 is opened about a shaft (not shown), the space of a cartridge mounting portion appears, and a guide comprising a boss and a rib, not shown, provided on the lengthwisely opposite outer sides of the process cartridge 8 is fitted to cartridge mounting guide members, not shown, disposed on the left and right of the space and is guided, thereby mounting and dismounting the process cartridges 8 (is mounted and dismounted) in the direction indicated by the double-headed arrow X (see FIG. 3) from the printer main body 301.

Also, the process cartridge 8 shown in the present embodiment has an antenna rod 20*i* as developer-remaining-amount detecting means for detecting the toner-remaining amount at a location spaced apart by a predetermined distance from t:he developing roller 20*d*. This antenna rod 20*i* measures the capacitance with the developing roller 20*d* to thereby measure the remaining amount of the toner. That is, the toner fed from the toner containing frame 20*a* by the toner feeding member 20*b*2 intervenes between the antenna rod 20*i* and the developing roller 20*d*. The antenna rod 20*i* and the developing roller 20*d* are electrically connected to electrodes (not shown) exposed on the outer portion of the process cartridge 8, and those electrodes in turn are connected to electrodes (not shown) disposed on the printer main body 301 side. The engine controller 326 of the printer main body 301 normally monitors the capacitance with the antenna rod 20*i* and the developing roller 20*d*. More particularly, when the toner is consumed and the toner in the toner containing frame 20*a* is depleted and further, even the toner between the antenna rod 20*i* and the developing roller 20*d* is consumed, the capacitance decreases. The engine controller 326, when the capacitance becomes smaller than a predetermined value, informs the video controller 327 that the toner remaining amount is slight. In response to the result, the video controller 327 causes an indicating portion (not shown) provided on the printer main body 301 or the display device (not shown) of the external device 331 to indicate such information.

(Image Forming Operation Construction of the Process Cartridge)

Figure 1:
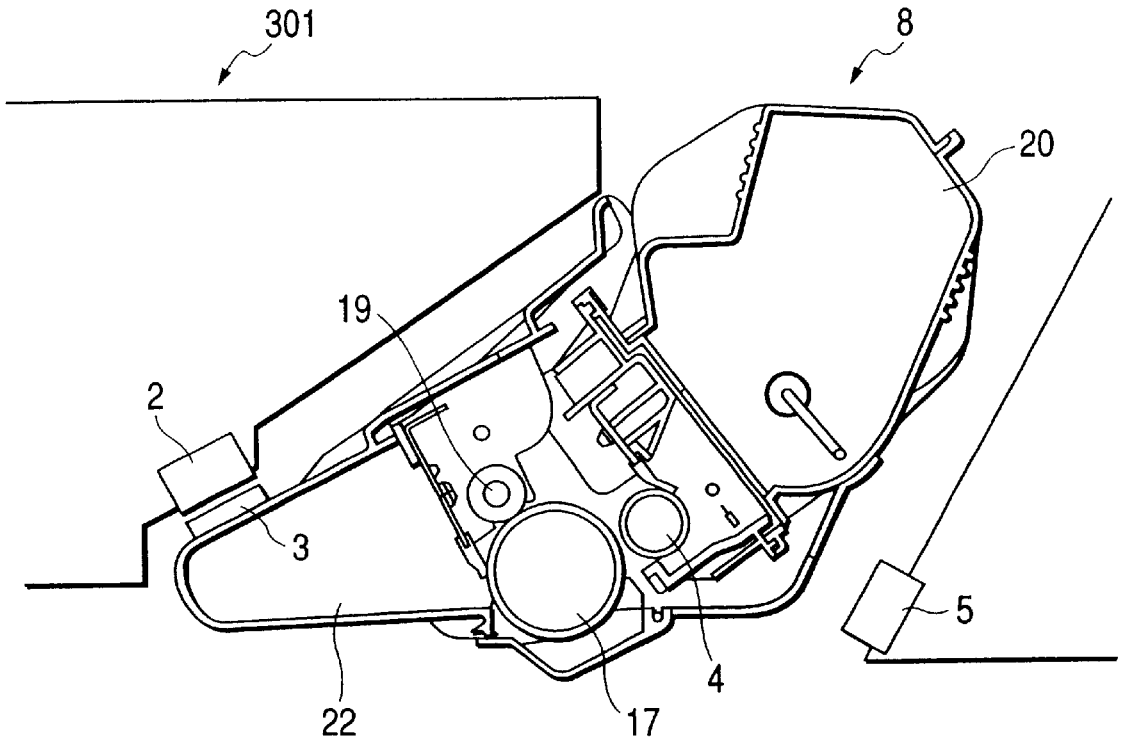
FIG. 1 is an illustration showing the positional relations between a noncontact transmission unit and a cartridge detecting element on a printer main body side in an electrophotographic image forming apparatus according to Embodiment 1 and a noncontact reception unit on a process cartridge side.
Figure 5:
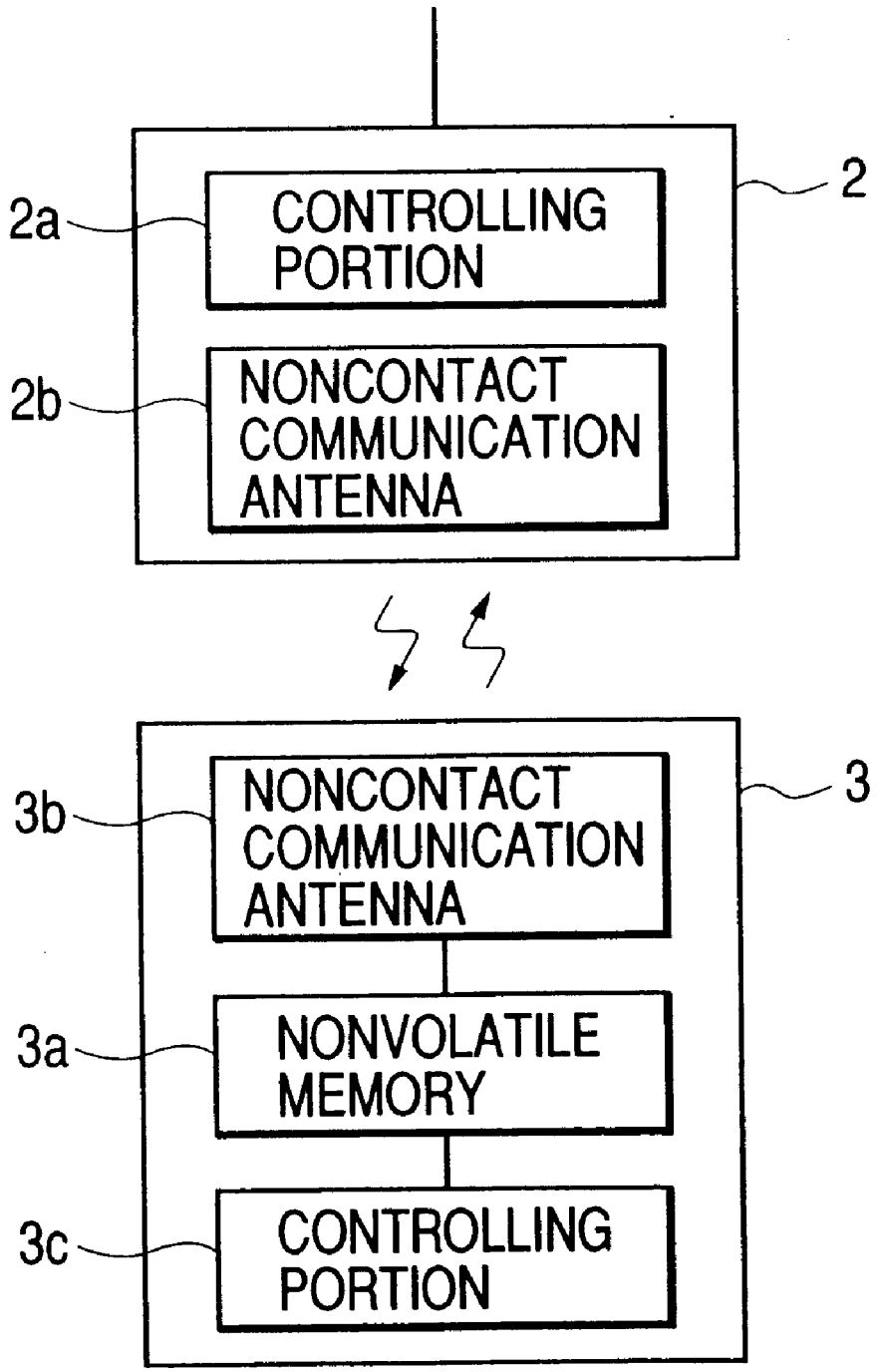
FIG. 5 is a block diagram schematically showing the constructions of the noncontact transmission unit and the noncontact reception unit.

The image-forming-operation construction of the process cartridge will now be described with reference to FIGS. 1, 3 and 5. FIG. 1 is an illustration showing the positional relations among a noncontact transmission-reception unit, i.e., a radio transmission unit, and a cartridge detecting element on the printer main body side in the electrophotographic image forming apparatus according to the present embodiment, and a noncontact reception unit, i.e., a radio reception unit, on the process cartridge side, and FIG. 5 is a block diagram schematically showing the constructions of the noncontact transmission unit and the noncontact reception unit.

The image forming operation construction of the process cartridge shown in the present embodiment is designed such that a noncontact memory unit, i.e., a radio memory unit, having a nonvolatile memory is provided in the process cartridge, and when interference occurs with communication between this noncontact memory unit and the noncontact transmission-reception unit capable of effecting noncontact communication, i.e., radio communication, provided in the printer main body, an operating panel as operating means is operated to thereby make the image forming operation of the process cartridge possible by the use of various standard parameter values in a memory portion stored and held by the engine controller.

A description will be provided in greater detail. In FIGS. 1 and 3, the reference numeral 3 designates a noncontact memory unit as cartridge noncontact communication means, i.e., cartridge radio communication means, carried on the process cartridge 8. This noncontact memory unit 3 is attached to the upper surface of the fore end of the cleaning frame 13 of the process cartridge 8. As shown in FIG. 5, it has a nonvolatile memory 3*a* as a memory element, a noncontact communication antenna 3*b* for effecting noncontact communication, i e., radio communication, with the noncontact transmission-reception unit (main body noncontact communication means, i.e., main body radio communication means) 2 attached to the printer main body 301 which will be described later, and a controlling portion 3*c* for controlling the nonvolatile memory 3*a* and the noncontact communication antenna 3*b*. The communication between the noncontact transmission unit 2 and the noncontact memory unit 3 is effected with a carrier wave being AM-modulated in the present embodiment. Various parameter values (various set values) as information necessary for the printing operation (image forming operation) performed by the process cartridge 8 are stored and held in advance in the nonvolatile memory 3*a*. The noncontact memory unit 3 shown in the present embodiment uses as a power source a voltage electromagnetically induced in the noncontact communication antenna 3*b* by the electromagnetic field of a carrier wave produced from the noncontact communication antenna 2*b* of the noncontact transmission-reception unit 2. Therefore, any external power source is not required. Also, at the same time, in accordance with a signal produced from the noncontact communication antenna 2*b* of the noncontact transmission-reception unit 2 (a signal for effecting the reading and writing of the various parameter values stored in the nonvolatile memory 3*a*), the controlling portion 3*c* effects the reading and writing of the nonvolatile memory 3*a*. The design is made such that by the controlling portion 3*c* effecting the reading and writing of the nonvolatile memory 3*a,* the various parameter values in the nonvolatile memory 3*a* can be represented as a change in impedance in the noncontact communication antenna 2*b*. Also, the design is made such that when a signal such as the number of prints (the number of image forming sheets) effected by the process cartridge 8 is produced from the noncontact communication antenna 2*b* of the noncontact transmission-reception unit 2, the noncontact memory unit 3 receives the signal by the noncontact communication antenna 3*b* and the controlling portion 3*c* writes the data of the number of prints into the nonvolatile memory 3*a*.

The reference numeral 2 designates a noncontact transmission-reception unit as main body noncontact communication means attached to the printer main body 301. The noncontact transmission-reception unit 2 is attached to a location opposed to the noncontact reception unit 3 with the process cartridge 8 mounted in the printer main body 301, and is electrically connected to the engine controller 326. As shown in FIG. 5, it has a controlling portion 2*a* for effecting the reading and writing of the aforementioned various parameter values stored by the nonvolatile memory 3*a* on the nonvolatile memory 3*a* of the noncontact memory unit 3, and a noncontact communication antenna 2*b* for effecting noncontact communication with the noncontact memory unit 3 carried on the process cartridge 8. The noncontact transmission-reception unit 2 shown in the present embodiment produces an electromagnetic field for the noncontact communication antenna 2*b* to be controlled by the controlling portion 2*a* and electromagnetically induce a voltage in the noncontact communication antenna 3*b* of the noncontact reception unit 3, and at the same time produces in the noncontact communication antenna 3*b* of the noncontact memory unit 3 a signal for effecting the reading and writing of the aforementioned various parameter values stored by the nonvolatile memory 3*a*. The design is made such that a change in impedance appearing in the noncontact communication antenna 3*b* of the noncontact memory unit 3 at this time is received by the noncontact communication antenna 2*b* and is read as the information of the aforementioned various parameter values by the controlling portion 2*a* and is delivered to the engine controller 326. Also, the design is made such that the noncontact transmission-reception unit 2 inputs the information, such as the number of prints of the process cartridge 8 delivered from the engine controller 326 by the controlling portion 2*a,* and produces a signal to that effect to the noncontact memory unit 3 through the noncontact communication antenna 2*b*.

The reference numeral 5 denotes a cartridge detecting element as cartridge detecting means attached to the printer main body 301, and it is attached to the lower surface of the process cartridge 8 mounted on the printer main body 301 at a location opposed to the developing unit D. Here, the lower surface is an underlying surface when the process cartridge 8 is mounted on the printer main body 301. The cartridge detecting element 5 is designed to effect the detection of the presence and absence of the process cartridge 8 by a mechanical, electrical, optical or magnetic detecting element. This cartridge detecting element 5 is electrically connected to the engine controller 326. When it detects that the process cartridge 8 has been rightly mounted on the printer main body 301, it delivers a cartridge detection signal to the engine controller 326.

The engine controller 326 has a memory portion (ROM) 326M as memory means, as shown in FIG. 3, and in this memory portion 326M, there is stored and held in advance various standard parameter values (various set values) as information necessary for the printing operation (image forming operation) performed by the process cartridge 8 mounted on the printer main body 301. The various parameter values stored in this memory portion 326M are the same as the various parameter values stored in the nonvolatile memory 3*a* of the noncontact memory unit 3 in the process cartridge 8. The engine controller 326, when starting the printing operation by the process cartridge 8 mounted on the printer main body 301, reads the various parameter values necessary for the printing operation stored and held in advance in the noncontact memory unit 3 on the process cartridge 8 side through the noncontact transmission-reception unit 2, and performs the printing operation while effecting the control of each portion in accordance with the parameter values. More particularly, it effects the optimum setting of charging, transferring, etc. necessary during the printing operation by the process cartridge 8, in accordance with the various parameter values received from the noncontact memory unit 3. Also, when the communication by the noncontact memory unit 3 and the noncontact transmission-reception unit 2 cannot be effected due to some abnormality or when an abnormality is found in data obtained by the communication, the engine controller 326 judges that there is some abnormality in the noncontact memory unit 3 of the process cartridge 8, and transmits the information to that effect to the video controller 327. In the video controller 327, by the information from the engine controller 326, it is indicated on an indicating portion (not shown) provided on the printer main body 301 that an error has occurred to the noncontact memory unit 3 of the process cartridge 8, to thereby inform the user of it and also stop the printing operation. Also, the engine controller 326 is adapted to deliver to the noncontact transmission-reception unit 2 information useful to the user such as the number of printed recording sheets S counted by a counting circuit, not shown, each time the process cartridge 8 performs the printing operation.

The reference numeral 300 (see FIG. 3) designates an operating panel as operating means provided on the printer main body 1. This operating panel 300 has an input key, and is designed so as to be capable of changing over to a mode for releasing and continuing the printing operation stopped by the video controller 327, by operating this input key.

Figure 4:
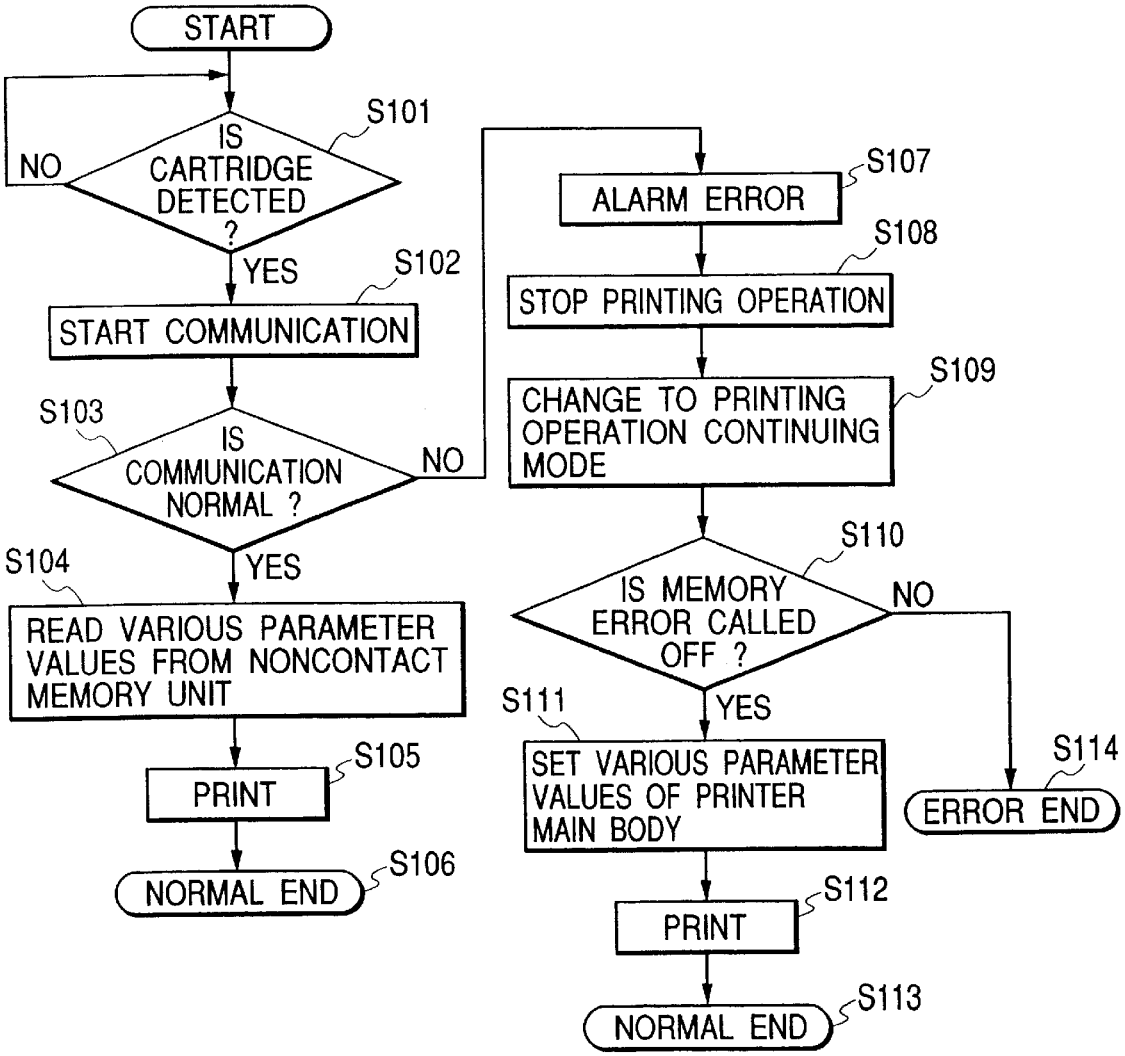
FIG. 4 is a flow chart showing the image forming operation of the process cartridge.

An operation will now be described on the basis of a flow chart shown in FIG. 4. First, when the cartridge detecting element 5 detects that the process cartridge 8 has been properly mounted (set) on the printer main body 301 (S1O1), the noncontact transmission-reception unit 2 starts its operation, and starts the communication with the noncontact memory unit 3 (S102).

If at S103, the communication between the noncontact transmission-reception unit 2 and the noncontact memory unit 3 is normal (yes), the engine controller 326 reads the various parameter values necessary for the printing operation stored and held in the nonvolatile memory 3*a* in the noncontact memory unit 3 through the noncontact transmission-reception unit 2 (S104), and effects the optimum setting of charging, transferring, etc. necessary during the printing operation by the process cartridge 8, in accordance with the various parameter values read from the noncontact memory unit 3. As a result, the printing operation of the process cartridge 8 is performed in accordance with the above-mentioned various parameter values and the printing of the recording sheets S is done (S105), and the printing operation for the recording sheets S by the process cartridge 8 ends normally (S106). At S105, the update of the content of the nonvolatile memory 3*a,* such as the number of prints, is effected each time the printing operation is performed, or as required.

Also, if at S103, the communication between the noncontact transmission-reception unit 2 and the noncontact memory unit 3 is not effected normally, or if an abnormality is found in data obtained by the communication (no), the engine controller 326 judges that there is some abnormality in the noncontact memory unit 3. In this case, the engine controller 326 reports to the video controller 327 that the noncontact memory unit 3 of the process cartridge 8 is abnormal. In the video controller 327, from the information from the engine controller 326, the user is informed that an error has occurred to the noncontact memory unit 3 of the process cartridge 8 (S107), and also the printing operation is stopped (S108). In the above-described case, the various parameter values for the printing operation by the process cartridge 8 cannot be obtained from the noncontact memory unit 3. So, in order to release the memory error of the noncontact memory unit 3, the user uses the input key on the operating panel 300 of the printer main body 301 to neglect the abnormality of the noncontact memory unit 3 and change over to a mode for continuing the printing operation in the engine controller 326 (S109).

When at S110, the memory error has been released (yes), the engine controller 326 uses the various standard parameter values stored in advance in the memory portion 326M as the information necessary for the printing operation by the process cartridge 8, and effects the optimum setting of charging, transferring, etc. necessary during the printing operation in accordance with these various parameter values (S111). As a result, the printing operation of the process cartridge 8 is performed in accordance with the above-mentioned various standard parameter values and the printing of the recording sheets S is done (S112), and the printing operation for the recording sheets S by the process cartridge 8 ends normally (S113). At S112, the update of the content of the nonvolatile memory 3*a* such as the number of prints is effected each time the printing operation is performed, or as required.

Also, if at S110, the memory error is not released (no), the memory error ends intactly (S114).

While in the present embodiment, the changeover to the continuing mode of the printing operation is effected by the use of the input key on the operating panel 300 provided on the printer main body 301, it is of course also possible to adopt a construction in which the changeover to the continuing mode of the printing operation is effected from the host apparatus such as the personal computer which is the external device 331.

Figure 2:
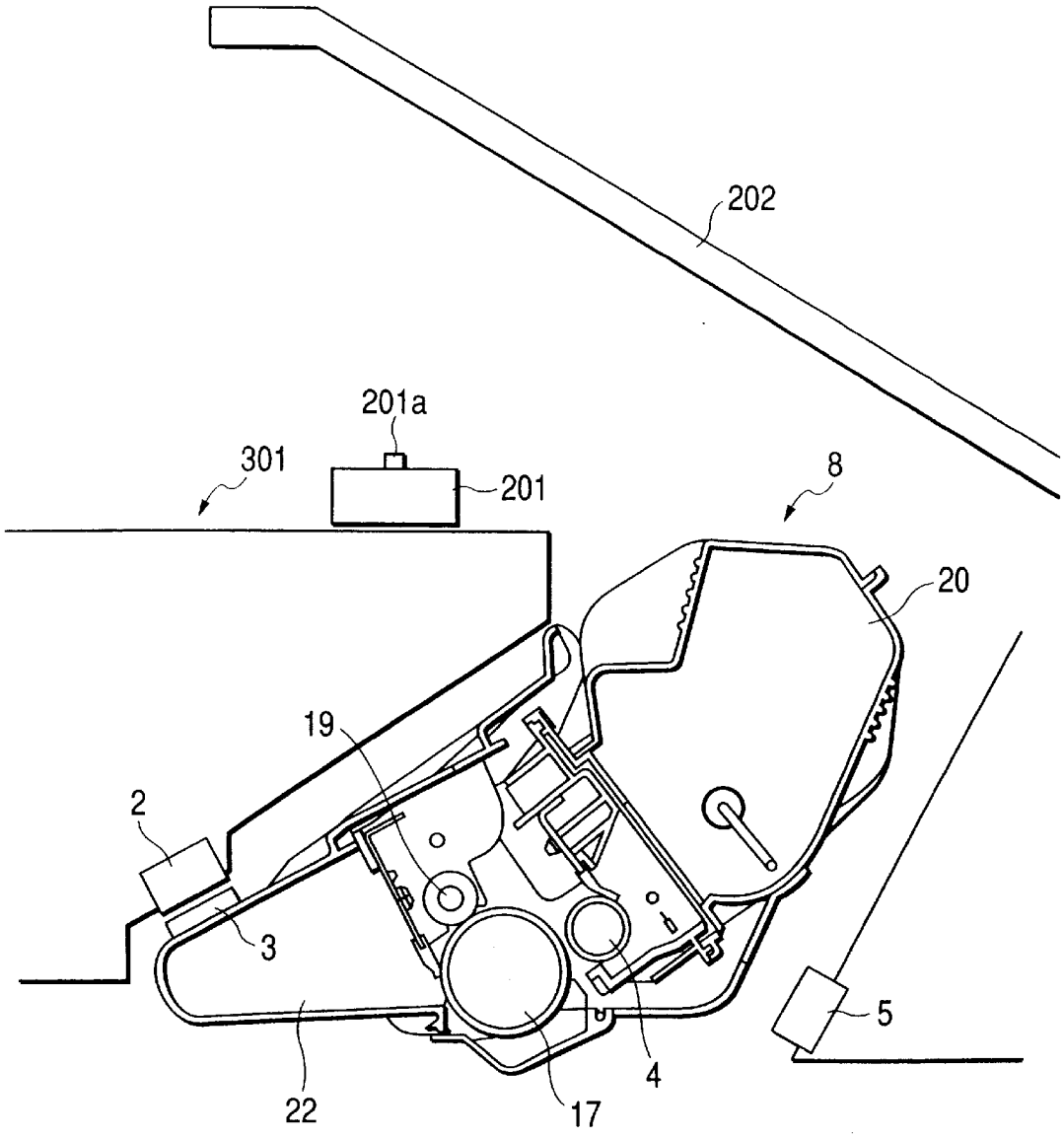
FIG. 2 is an illustration of an electrophotographic image forming apparatus according to Embodiment 2.

An electrophotographic image forming apparatus according to the present embodiment will now be described with reference to FIG. 2. FIG. 2 is an illustration of the electrophotographic image forming apparatus according to the present embodiment.

The electrophotographic image forming apparatus according to the present embodiment is characterized in that the stoppage of the printing operation by the error of the noncontact memory unit 3 described in the aforedescribed Embodiment 1 can be released by a hardware switch 201 provided on the printer main body 301. Accordingly, the electrophotographic image forming apparatus according to the present embodiment is the same in construction as the electrophotographic image forming apparatus according to Embodiment 1 with the exception that instead of the operating panel 300 which is the operating means described in Embodiment 1, the hardware switch 201 is used to release the stoppage of the printing operation of the engine controller 326. The printing operation using the various parameter values necessary for the printing operation stored in the noncontact memory unit 3 or the memory portion 326M of the engine controller 326 is also the same as the operation described in Embodiment 1.

A description will be provided in greater detail. The hardware switch 201, as shown in FIG. 2, is provided on a portion at which a door 202 for inserting the process cartridge 8 is opened. This hardware switch 201 has, for example, a closable and openable switch button 201*a*. This hardware switch 201 is used to release the stoppage of the printing operation by the error of the noncontact memory unit 3. That is, when, in spite of the process cartridge 8 having been properly mounted (set) on the printer main body 301 and the cartridge detecting element 5 having detected the process cartridge 8, the communication between the noncontact transmission-reception unit 2 and the noncontact memory unit 3 is not effected normally, or an abnormality is found in the data obtained by the communication, the video controller 327 informs the user that an error has occurred to the noncontact memory unit 3 of the process cartridge 8 and also, when the printing operation has been stopped, as shown in FIG. 2, the door 202 is opened and the switch button 201*a* is depressed and closed, whereupon the engine controller 326 releases the stoppage of the printing operation. As a result, the engine controller 326, as in Embodiment 1, uses the various standard parameter values stored in advance in the memory portion 326M as the information necessary for the printing operation by the process cartridge 8, and effects the optimum setting of charging, transferring, etc. necessary during the printing operation in accordance with these various parameter values. Therefore, the printing operation of the process cartridge 8 is performed in accordance with the above-mentioned various standard parameter values and the printing of the recording sheets S is done, and the printing operation for the recording sheets S by the process cartridge 8 ends normally.

While the present embodiment is of a construction in which the hardware switch 201 is used to release the stoppage of the printing operation of the engine controller 326 by the error of the noncontact memory unit 3, it is of course also possible to use this construction with the method by the key input from the operating panel 300 as shown in Embodiment 1, or a method of effecting the release by the setting from the host side, such as the personal computer, which is the external device 331. In such case, a method giving printing to a software input capable of releasing the error from the operating panel 300 even if the hardware switch 201 is effective to stop the error is considered to be suitable.

As described above, in the present embodiment, in the electrophotographic image forming apparatus which has the detachably mountable process cartridge 8 incorporating the photosensitive drum 17 therein and in which the photosensitive drum 17 is exposed by a laser unit (laser source) 313 modulated in conformity with an image signal to thereby form an electrostatic latent image, which is then formed into a developer image by the developing means 20, the noncontact memory unit 3 having the nonvolatile memory 3*a* is provided on the process cartridge 8, and even when interference attributable to the noncontact memory unit 3 occurs with the communication between the noncontact memory unit 3 and the noncontact transmission-reception unit 2 capable of effecting noncontact communication provided in the printer main body 301, the engine controller 326 makes the image forming operation by the process cartridge 8 possible by the use of the various standard parameter values in the memory portion 326M under a predetermined condition that the operating panel 300 as operating means or the hardware switch 201 is operated.

As a result, the image forming operation by the process cartridge 8 becomes possible even when, due to some cause or other, the noncontact memory unit 3 is not carried on the process cartridge 8 or the communication with the noncontact memory unit 3 cannot be done normally. Also, it is possible to avoid such a situation that even if the amount of toner in the process cartridge is sufficient, printing becomes impossible by a process cartridge 8 abnormal in the noncontact memory unit 3. From this, even when the data of the noncontact memory unit 3 of the process cartridge 8 cannot be read rightly, it becomes possible to resume the printing operation at a point in time in which it has been judged that there is no problem in the toner remaining amount, etc.

While the electrophotographic image forming apparatuses shown in the aforedescribed embodiments have been illustrated with respect to a case where information such as the number of prints is communicated in a noncontact fashion between the apparatus and the process cartridge for forming monochromatic images, the present invention can also be suitably applied to an image forming apparatus in which developing means is provided in each of a plurality of cartridges as process cartridges and information, such as the number of prints, is communicated in the noncontact fashion between the apparatus and each cartridge for forming an image of plural colors (e.g., a two-color image, a three-color image or a full color image).

Also, the electrophotographic photosensitive members of the process cartridges shown in the aforedescribed embodiments are not limited to the photosensitive drums, but include, for example, the following. First, as the photosensitive member, use is made of a photoconductor, and as the photoconductor, for example, amorphous silicon, amorphous selenium, zinc oxide, titanium oxide and an organic photoconductor (OPC) are included. Also, as the shape for carrying the photosensitive member thereon, use is made of a drum shape or a belt shape, and for example, in a drum type photosensitive member, a photoconductor is deposited by evaporation or applied by coating onto a cylinder of an aluminum alloy or the like.

Also, as the developing method, use can be made of one of various methods such as conventional two-component magnetic brush development, cascade development, touch down development and cloud development.

As regards the construction of the charging means, the so-called contact charging method has been used in the aforedescribed embodiments, but as a matter of course, use may be made of a conventionally used construction in which a metal shield of aluminum or the like is provided around the three sides of a tungsten wire and positive or negative ions created by a high voltage being applied to the tungsten wire are moved to the surface of a photosensitive drum, and the surface of the drum is uniformly charged.

The charging means is not restricted to the aforedescribed roller type, but may be of a blade type (charging blade), a pad type, a block type, a rod type, a wire type or the like.

Also, as the method of removing the toner residual on the photosensitive drum, cleaning means may be constructed by the use of a blade, a fur brush, a magnetic brush or the like.

Also, the aforedescribed process cartridge is provided, for example, with an electrophotographic photosensitive member and at least one of process means. Accordingly, the modes of the process cartridge include, besides the ones in the aforedescribed embodiments, for example, an electrophotographic photosensitive member and charging means integrally made into a cartridge detachably mountable on the main body of the apparatus, an electrophotographic photosensitive member and developing means integrally made into a cartridge detachably mountable on the main body of the apparatus, an electrophotographic photosensitive member and cleaning means integrally made into a cartridge detachably mountable on the main body of the apparatus, and further an electrophotographic photosensitive member and two or more of the process means combined together and integrally made into a cartridge detachably mountable on the main body of the apparatus.

That is, the aforedescribed process cartridge is charging means, developing means or cleaning means and an electrophotographic photosensitive member integrally made into a cartridge that is detachably mountable to the main body of the image forming apparatus. Or the process cartridge is at least one of charging means, developing means and cleaning means and an electrophotographic photosensitive member integrally made into a cartridge that is detachably mountable to the main body of the image forming apparatus. Further, the process cartridge refers to at least developing means and an electrophotographic photosensitive member integrally made into a cartridge that is detachably mountable to the main body of the image forming apparatus. This process cartridge can be mounted and dismounted to the main body of the apparatus by the user himself. So, the maintenance of the main body of the apparatus can be done by the user himself.

Further, while in the aforedescribed embodiments, a laser beam printer has been illustrated as the electrophotographic image forming apparatus, the present invention need not be restricted thereto, but can of course also be used in an electrophotographic image forming apparatus such as an electrophotographic copier, a facsimile apparatus or a word processor.

As described above, according to the electrophotographic image forming apparatus according to the present invention, when interference occurs with the communication by the cartridge radio communication means and the main body radio communication means, the main body controlling means uses the information necessary for the image forming operation stored and held in advance under a predetermined condition to make the image forming operation by the process cartridge possible. As a result, even if for example, an abnormality or the like occurs to the cartridge radio communication means and the radio communication by the main body radio communication means cannot be effected, the image forming operation by the process cartridge can be made possible under a predetermined condition. So, the usability of the electrophotographic image forming apparatus can be improved.

While the invention has been described with reference to the structure disclosed herein, it is not confined to the details set forth and this application is intended to cover such modifications or changes as may come within the purposes of the improvements or the scope of the following claims.

What is claimed is:

1. An electrophotographic image forming apparatus to which a process cartridge is detachably mountable for forming an image on a recording medium, said electrophotographic image forming apparatus comprising:

(i) a mounting portion for detachably mounting said process cartridge, said process cartridge having:
- an electrophotographic photosensitive member;
- process means for acting on said electrophotographic photosensitive member;
- a cartridge memory for storing cartridge information, on the basis of which said process cartridge performs an image forming operation; and
- a communication member for transmitting said cartridge information stored in said cartridge memory to a main body of said electrophotographic image forming apparatus;

(ii) a detecting member for detecting that said process cartridge is mounted on said mounting portion; and (iii) a controller for receiving said cartridge information stored in said cartridge memory through said communication member before said image forming operation, and for controlling said image forming operation on the basis of said cartridge information, wherein when said controller cannot receive said cartridge information through said communication member in a state in which said detecting member detects that said process cartridge is mounted on said mounting portion, said controller controls said image forming operation under a predetermined condition on the basis of main body information stored in advance in a memory portion provided in said image forming apparatus.

2. An electrophotographic image forming apparatus according to claim 1, wherein said cartridge information includes information regarding a charge and information regarding a transfer, and wherein said controller controls said image forming operation on the basis of said cartridge information.

3. An electrophotographic image forming apparatus according to claim 1, wherein even when said controller decides that there is an abnormality in said cartridge information received by said controller through said communication member, said controller also generates error information.

4. An electrophotographic image forming apparatus according to claim 3, wherein when said error information is generated, said controller indicates the occurrence of an error and stops said image forming operation, and thereafter by an operator releasing a stop of said image forming operation, said controller controls said image forming operation on the basis of said main body information.

5. An electrophotographic image forming apparatus according to claim 4, wherein a release of said stop is achieved by an input-key operation of the operator, by a mode changeover operation of a host device, or by a hardware switch.

6. An electrophotographic image forming apparatus according to claim 5, wherein when the release of said stop is not achieved, said controller finishes said image forming operation.

7. An electrophotographic image forming apparatus according to claim 1, wherein said main body information includes various standard parameter values.

8. An image forming apparatus to which a process unit is detachably mountable for forming an image on recording medium, said image forming apparatus comprising:

a mounting portion for detachably mounting said process unit, said process unit having:

an image bearing member;

process means for acting on said image bearing member;

a non-volatile memory for storing information necessary for an image forming operation, on the basis of which said process unit performs an image forming operation; and a radio communication member for transmitting said information stored in said non-volatile memory to a main body of said image forming apparatus;

a detecting member for detecting that said process unit is mounted on said mounting portion;

a controller for receiving said information stored in said non-volatile memory through said radio communication member before said image forming operation, and for controlling said image forming operation on the basis of said information stored in said non-volatile memory, wherein said controller determines whether a communication of said radio communication member is normal in a state in which said detecting member detects that said process unit is mounted on said mounting portion, and wherein if the communication is normal, said controller controls said image forming operation on the basis of said information stored in said non-volatile memory, and wherein if the communication is not normal, said controller stops said image forming operation; and releasing means for issuing an instruction for releasing the stopping of said image forming operation when the communication of said radio communication member is not normal, wherein when the stopping of said image forming operation is released by said releasing means, said controller enables said image forming operation on the basis of predetermined information stored in a memory portion provided in said image forming apparatus.

9. An image forming apparatus according to claim 8, wherein said releasing means comprises an operation panel or an external device, and said releasing means releases the stopping of said image forming operation on the basis of a key input of said operation panel or an instruction signal from said external device.

10. An image forming apparatus according to claim 8, wherein said radio communication member has a communication antenna, wherein the communication is performed by an electromagnetic wave generated from said communication antenna.

* * * * *

UNITED STATES PATENT AND TRADEMARK OFFICE

CERTIFICATE OF CORRECTION

PATENT NO. : 6,556,792 B2
DATED : April 29, 2003
INVENTOR(S) : Shotaro Yoshimura It is certified that error appears in the above-identified patent and that said Letters Patent is hereby corrected as shown below:

Title page,
Item [57], ABSTRACT,
Line 3, should be deleted.

Column 2,
Line 61, “use” should read -- used --.

Column 5,
Line 40, “t:he” should read -- the --.

Column 9,
Line 17, “param-” should read -- para- --.
Line 18, “eter” should read -- meter --.

Signed and Sealed this

Ninth Day of March, 2004

JON W. DUDAS
*Acting Director of the United States Patent and Trademark Office*